US006083055A

United States Patent [19]

Chuang

[11] Patent Number: 6,083,055

[45] Date of Patent: Jul. 4, 2000

[54] LAMP ASSEMBLY

[76] Inventor: Te-Chun Chuang, 3 Shui-Mei, Shuang-Hsi, Pao-Shan, Hsinchu, 308, Taiwan

[21] Appl. No.: 09/209,041

[22] Filed: Dec. 10, 1998

[51] Int. Cl.[7] ..... H01R 17/00

[52] U.S. Cl. ..... 439/699.2; 439/680

[58] Field of Search ..... 439/617–619, 439/611, 699.2, 419, 680

[56] References Cited

U.S. PATENT DOCUMENTS

| | | | |
|---|---|---|---|
| 4,573,754 | 3/1986 | Hill | 439/699.2 |
| 4,631,651 | 12/1986 | Bergin et al. | 439/699.2 |
| 4,647,132 | 3/1987 | Mikola | 439/699.2 |
| 5,630,729 | 5/1997 | Francis | 439/699.2 |
| 5,647,771 | 7/1997 | Shu | 439/699.2 |
| 5,672,000 | 9/1997 | Lin | 439/419 |
| 5,795,189 | 8/1998 | Liou | 439/699.2 |

*Primary Examiner*—Hien Vu
*Attorney, Agent, or Firm*—Rabin & Champagne, P.C.

[57] ABSTRACT

An improved lamp assembly which contains a light emitting element, a holder, a socket seat and copper tabs among which the light emitting element is placed in the holder by means of a pair of matched flat areas thereof for correct positioning, polarity identification of the light emitting element, and for a tight fit thereof; the holder of the light emitting element is plugged in a socket seat by means of a pair of flat matching areas or a key pair for correct positioning thereof; furthermore, in order to connect the light emitting element to the copper tabs with a correct polarity, the copper tabs have different areas which facilitates polarity identification, quick assembling so that an improved lamp assembly can be obtained featuring its easy assembling, correct polarity identification, excellent fitting, short assembling process and improved productivity.

5 Claims, 6 Drawing Sheets

LAMP ASSEMBLY

FIELD OF THE INVENTION

The present invention involves an improved lamp assembly featuring its easy assembling, correct polarity identification and excellent fitting.

BACKGROUND OF THE INVENTION

A conventional lamp assembly is shown in FIG. 1. The lamp assembly consists of a bulb 11, a holder 12, a socket seat 13, copper tabs 14 and a power cable 15. The bulb 11 is placed in the holder 12 with its leads 111 passing through and turned up and being against outer sides of the holder 12 (not shown in FIG. 1). The copper tabs 14 are arranged against inner sides of the socket seat 13. When the holder 12 of the bulb 11 is placed in the socket seat 13, the turned up leads 111 will contact with the copper tabs 14 respectively to form an electrical connection. However in using the lamp assembly, the leads 111 which are turned up and against the holder 12 will come off occasionally; furthermore, on engagement of the holder 12 and the socket seat 13 may be broken due to a gap between them, or the electric circuit disconnection will occur for the uncontacted copper tab 14 with leads 111 further, the bulb 11 has a shorter service life of ca 1000 hours, so, some improvement has been obtained by using a light emitting element (light emitting dipolar substance) as a substitute for the bulb 11 in order to prolong the service life up to 50,000 hours. Although substitution of a light emitting element for the bulb 11 may prolong the service life, the light emitting element must have polarity which matches the polarity of the copper tabs when assembling thus causing an inconvenient assembling process. For example, the lamp assembly 10 is usually used in a lamp string. If one of the lamp assemblies 10 has its polarity misconnected, the lamp string circuit will not work, and it will take a lot of time to find out the wrong point. Therefore, the shortcomings mentioned above will result in an inconvenient assembling process and application. The present invention is directed to an improved lamp assembly featuring easy assembling and excellent fitting.

SUMMARY OF THE INVENTION

The major object of the present invention is to provide a lamp assembly with excellent fitting, in which flat matching areas, key pairs etc. are arranged in corresponding positions of the light emitting element, the holder and the socket seat in order to give easy assembling, and better and tight fitting.

Another object of the present invention is to provide an improved lamp assembly with the polarity identified correctly. A matching flat area or a key pair is provided in the light emitting element to identify the polarity the leads and the external polarity thereof for correct connection with the copper tabs respectively, which have different areas for correct polarity identification to the light emitting element.

The object, characteristics and functions of the present invention can be best described in detail in conjunction with the accompanying drawings and the following embodiment hereinafter:

DETAILED DESCRIPTION OF THE INVENTION

Figure 1:
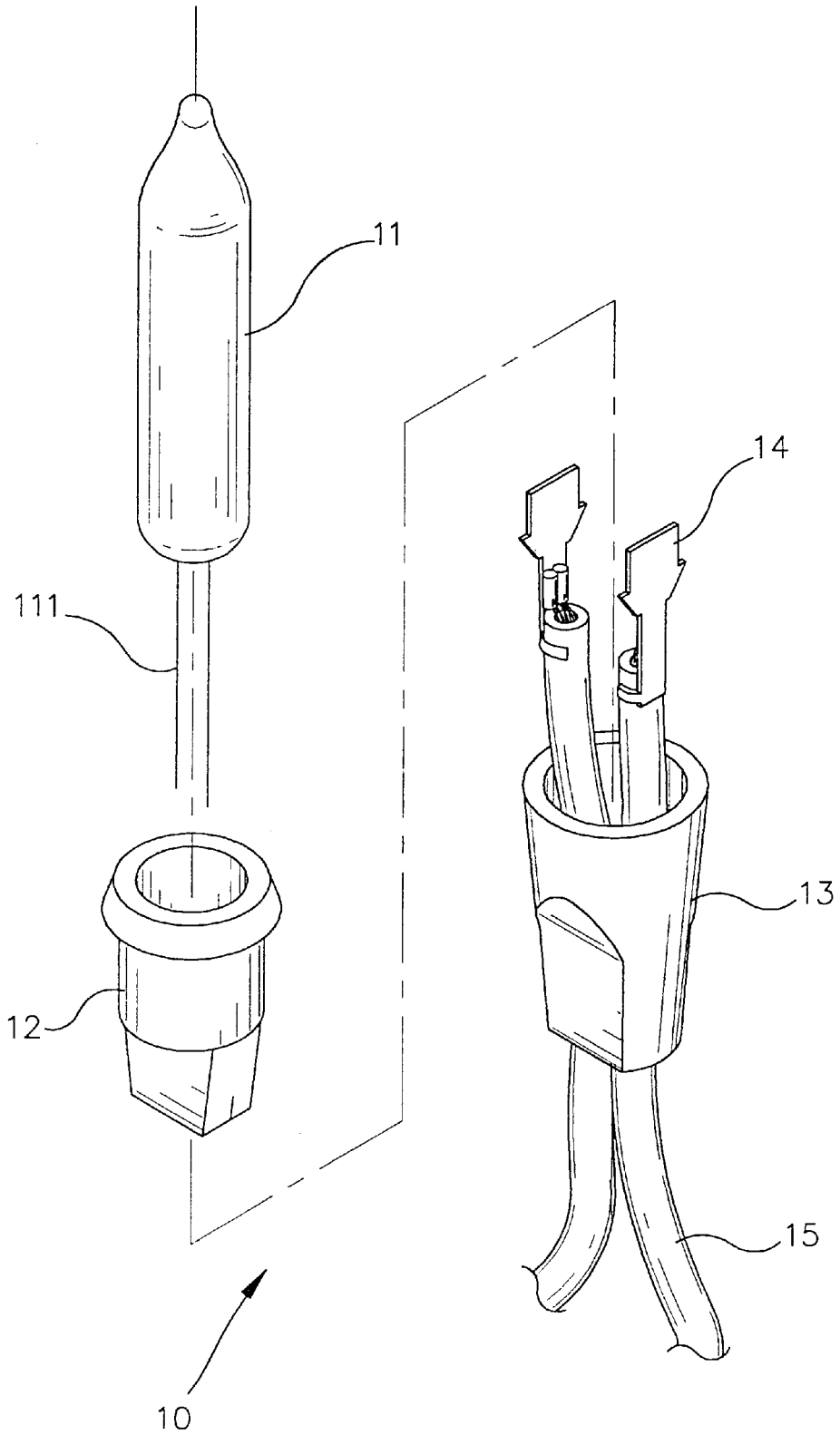
FIG. 1 PRIOR ART
FIG. 1 is an exploded view of a conventional lamp assembly.
Figure 2:
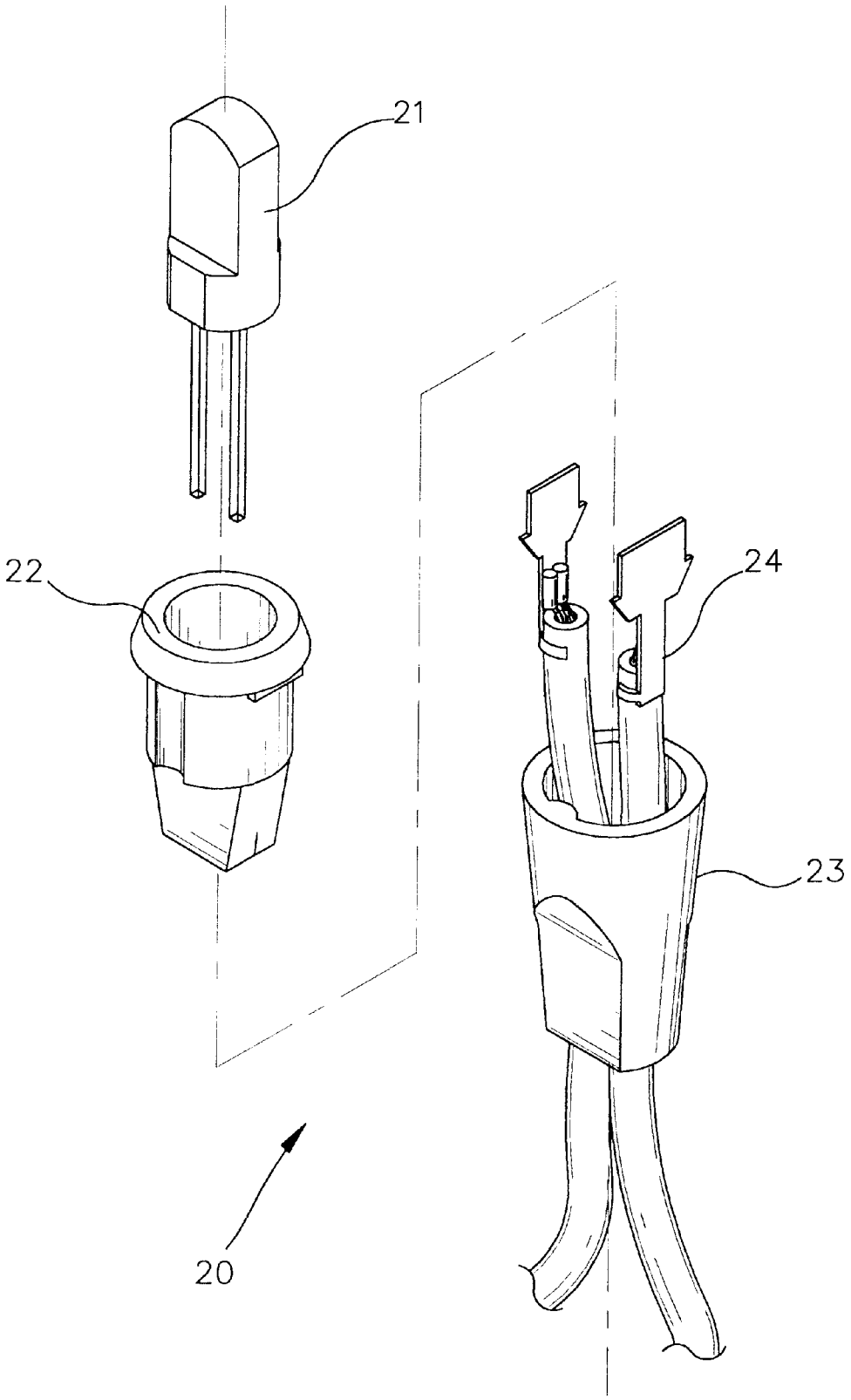
FIG. 2 is an exploded view of a lamp assembly of the present invention.
Figure 3:
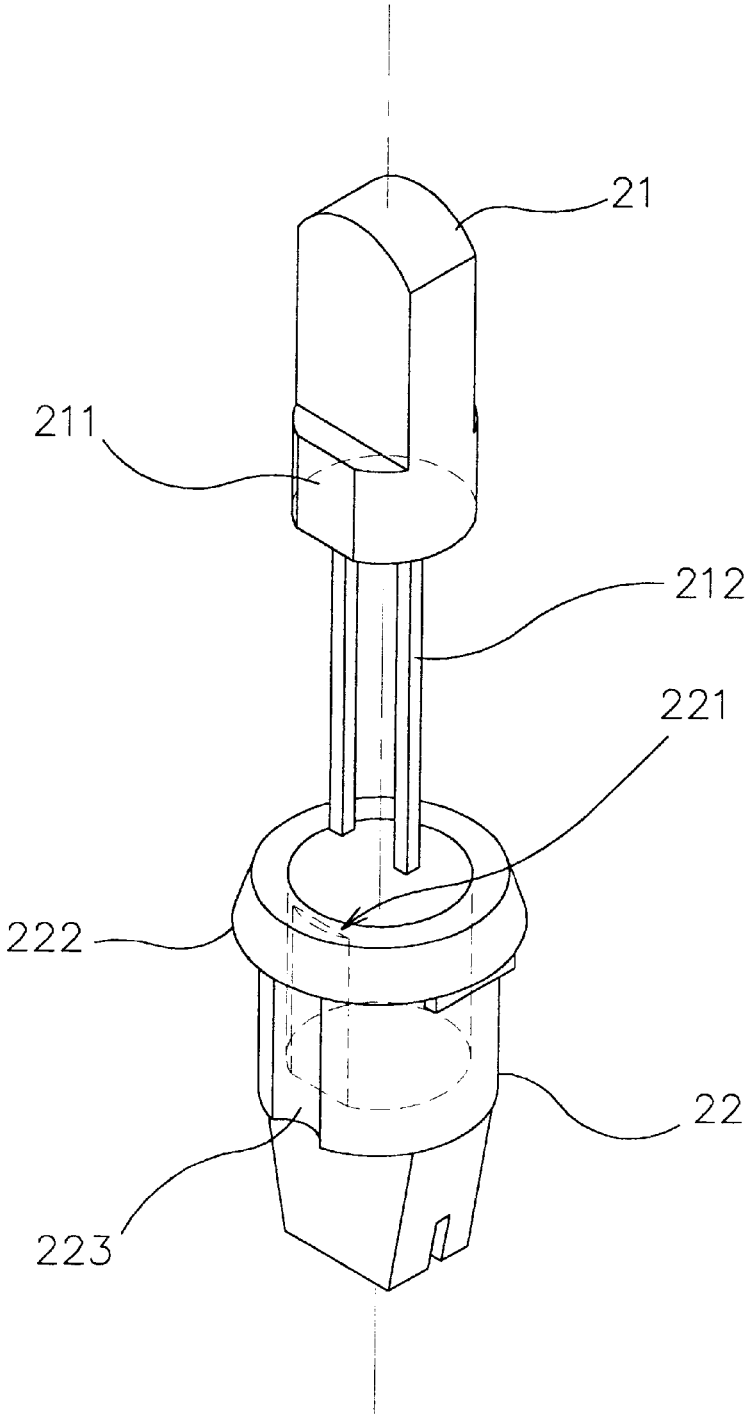
FIG. 3 is a schematic engagement view of a light emitting element with a holder of the present invention.

FIG. 2 is an exploded view of a lamp assembly of the present invention in which the lamp assembly 20 of the present invention includes a light emitting element 21, a holder 22, a socket seat 23 and a pair of copper tabs 24. Referring to FIGS. 3–5, a schematic engagement views of a light emitting element with a holder is shown. In order to enable to fit the light emitting element 21 in the holder 22 firmly, a fitting structure which can be a pair of flat matching areas or a key pair is provided at a proper point between the light emitting element 21 and the holder 22. In the example of embodiment of the present invention shown in FIG. 3, the light emitting element has a base with an asymmetrical configuration. For example, it may have a pair of flat surface matching areas 211, 221 for fitting of the light emitting element 21 with the holder 22, with the flat surface matching areas arranged at a proper point of the light emitting element 21 and the holder 22 That makes the light emitting element 21 possible to fit firmly in the holder 22 by means of the flat matching areas 211, 221 without accidental separation of them. Meanwhile, a design of the pair of flat matching areas is possible to define previously polar position of the leads 212 of the light emitting element 21 That is, it is supposed that a positive lead 212 is on the left-hand side of the flat area 211, a lead 212 on the right-hand side of the flat area 211 will be negative. Awareness of the polarity of the leads 212 will result in correct followed assembling.

Figure 4B:
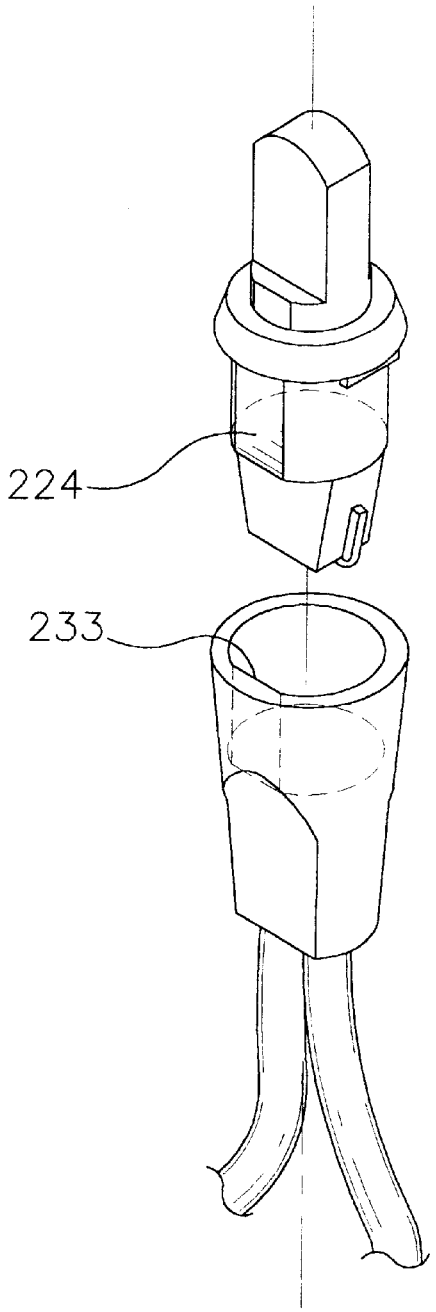
FIG. 4B is a schematic engagement view of a holder with a socket seat of the present invention (II)
Figure 4A:
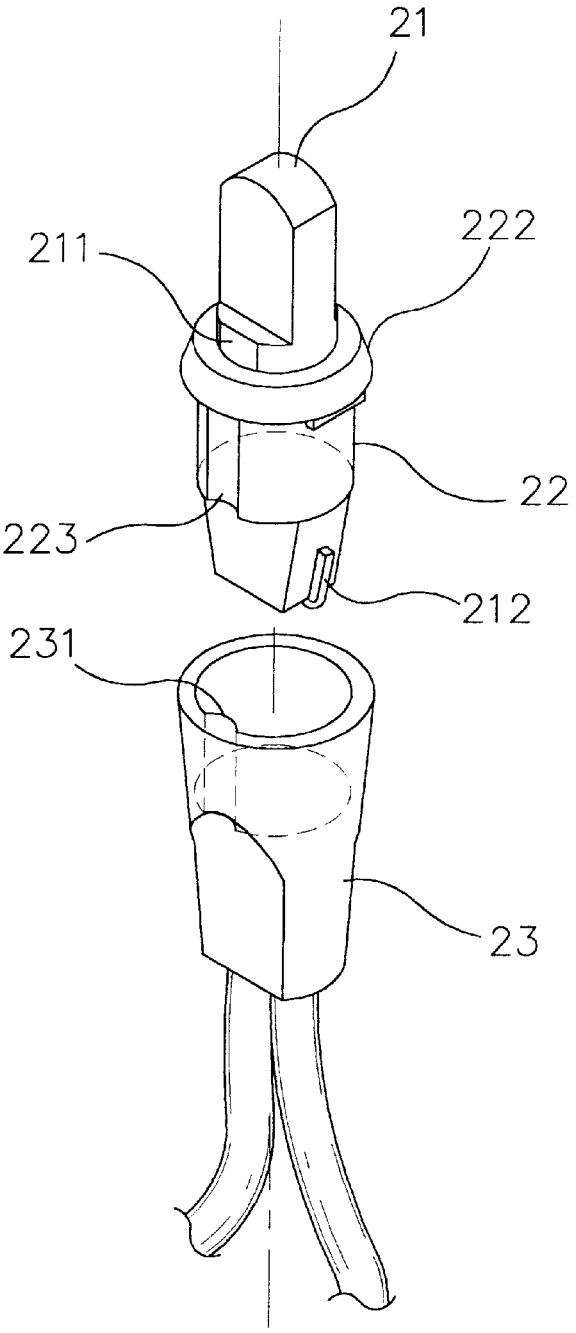
FIG. 4A is a schematic engagement view of a holder with a socket seat of the present invention (I)
Figure 5:
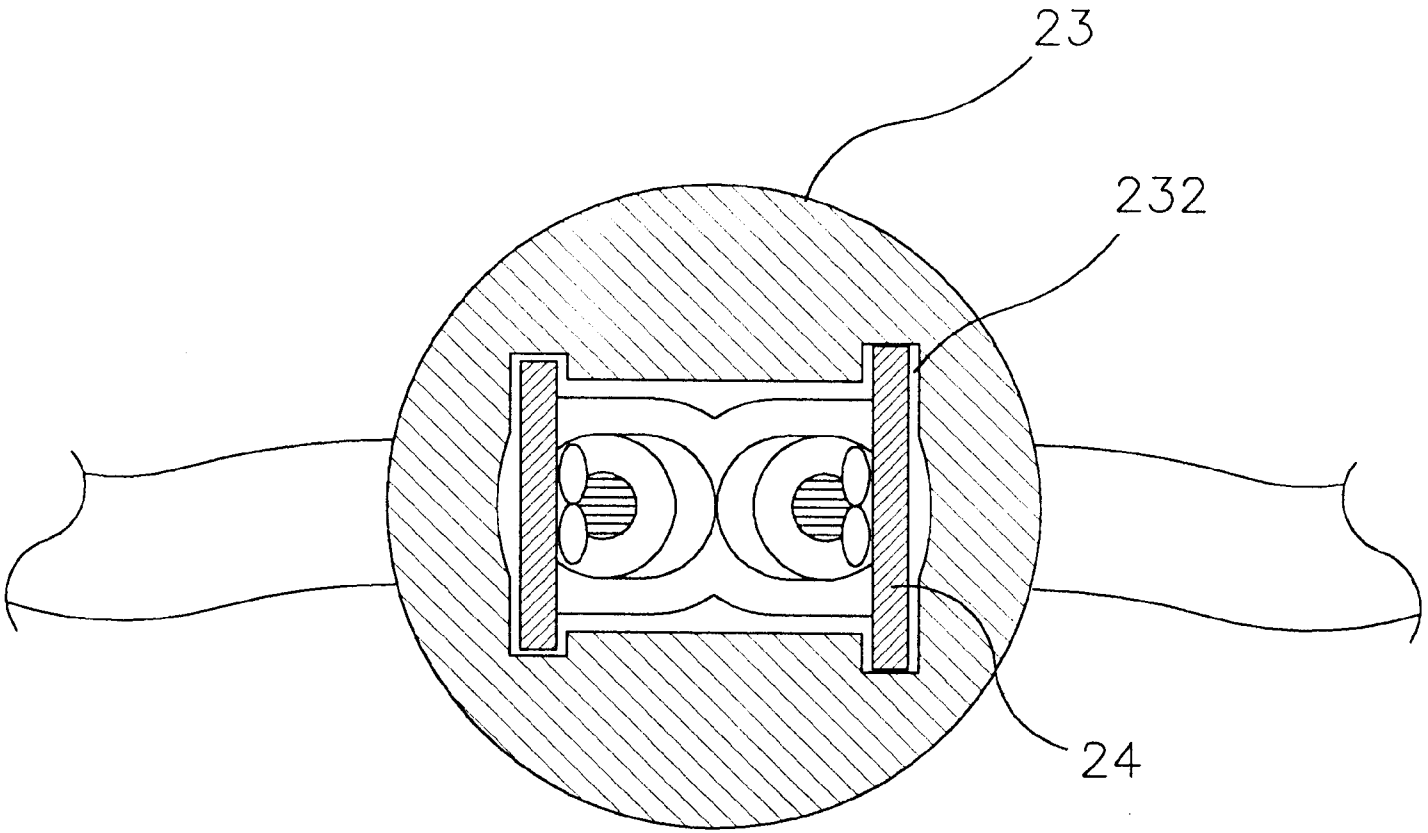
FIG. 5 is a sectional engagement view of a socket seat with copper tabs of the present invention.

FIG. 4 is a schematic engagement view of a holder with a socket seat of the present invention. In order to fit the holder 22 firmly in the socket seat 23, a keyway (recessed surface portion) 223 is provided at a proper point of the holder 22 (as shown in FIG. 4A), and a key (projection surface portion) 231 is arranged at a point of the socket seat 23 corresponding to the keyway 223. Fitting of the keyway 223 with the key 231 allows the holder 22 to be placed into the socket seat 23 correctly. Alternately, in order to fit the holder 22 with the socket seat 23 correctly, fitting of the holder 22 with the socket seat 23 can be carried out by means of a pair of flat surface matching areas 224 and 233 (as shown in FIG. 4B) which allows the holder 22 to be fitted in the socket seat 23 firmly without accidental separation.

FIG. 5 is a sectional engagement view of a socket seat with copper tabs of the present invention. Referring also to FIG. 2, two receptacles with different sizes 232 are provided in the internal wall of the socket seat 23. Correspondingly, the copper tabs 24 have different sizes for the polarity identification. When the larger one is positive, the small one will be negative. In addition to the polarity identifying method for the leads 212 shown in FIG.3, the polarity identifying method for the copper tabs makes operators to be able to fit the holder 22 with the socket seat 23 easily and correctly resulting in simplified assembling process, time saving and improved productivity.

Figure 6:
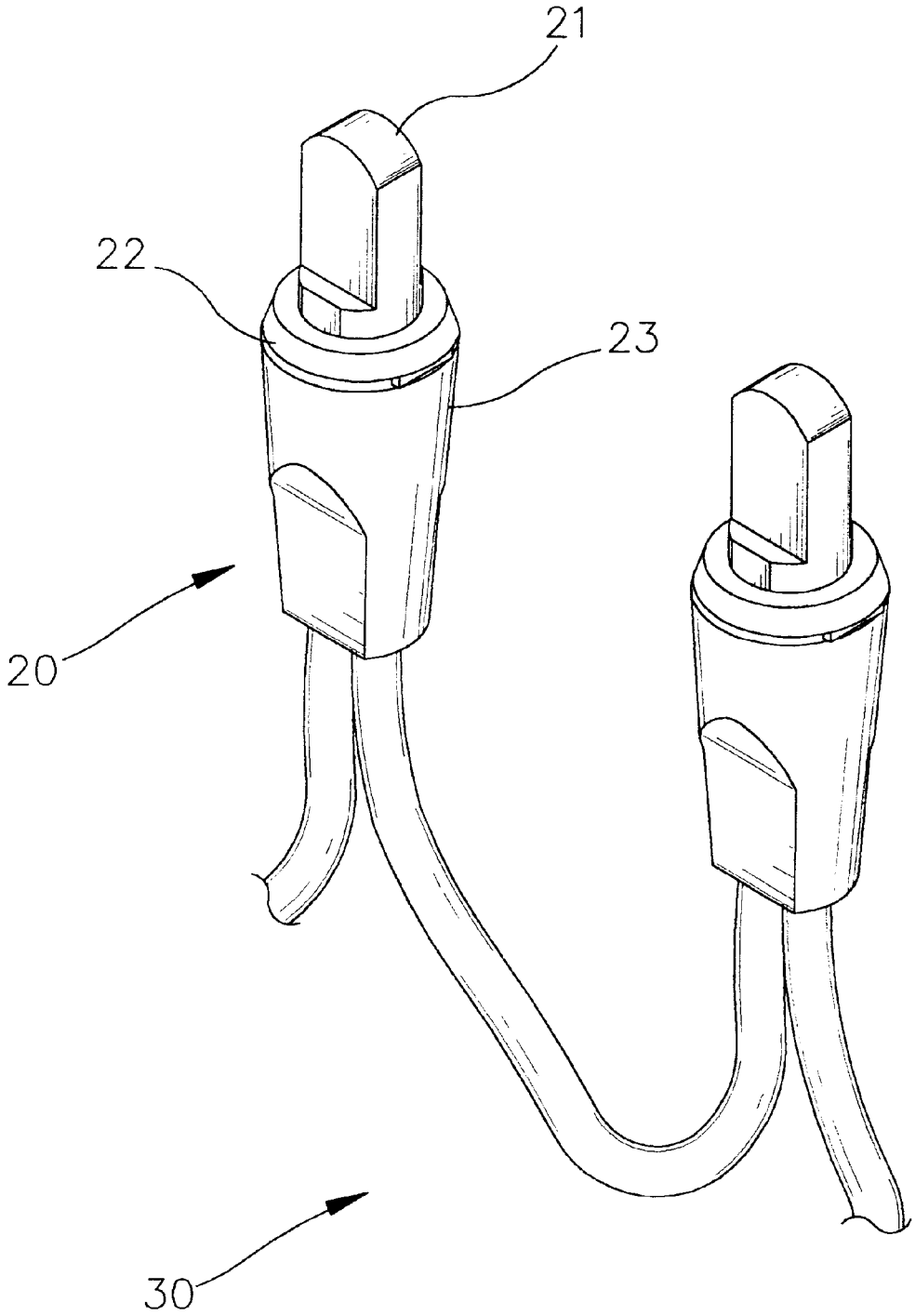
FIG. 6 is a schematic view of a lamp assembly of the present invention connected in a lamp string.

According to FIG. 6, the lamp assemblies 20 connected one by one forms a lamp string 30. Each lamp assembly 20 in the string 30 is connected to each other in series mode.

Therefore, if any one of the lamp assemblies 20 in the string 30 is connected wrongly in the polarity, the lamp string 30 will not work. So, when a light emitting element is used, correct polarity arrangement will be important, and the present invention may overcome all the shortcomings in the assembling process of a conventional lamp assembly, effectively and completely, giving an improved lamp assembly 20 with correct and quick assembling and excellent fitting.

As seen according to the above, the present invention 'Improved Lamp Assembly' has really the practical applicability and the creativeness, and has never been published to the public, that conforms to the regulations stipulated in the Patent Law.

The embodiment mentioned above is only a better example for the present invention, and shall not restrict the range of embodiment of the present invention to it, and any modification or/and change made based on the present invention shall be considered to be covered by the present invention.

What is claimed is:

1. A lamp assembly, comprising:

a light emitting element having a base with an asymmetrical configuration having different shaped surfaces on each side, and having first and second leads;

a holder having a receptacle for receiving the base of said light emitting element, the receptacle having a configuration corresponding to the configuration of the base so that the base can be received in the receptacle in only one position, said holder further having a plug portion having an outer periphery with an asymmetrical configuration having different shaped surfaces on each side;

a socket seat having a receptacle for receiving the plug portion of said holder, the receptacle of said socket seat having a configuration corresponding to the asymmetrical configuration of the outer periphery of said plug portion so that said plug portion can be received in the receptacle of said socket seat in only one position, said socket seat further having first and second further receptacles in a base portion thereof, said first and second further receptacles each being differently sized; and first and second conductive tabs, said first and second conductive tabs each being differently sized, said first conductive tab having a size corresponding to a size of the first further receptacle and being received therein, and said second conductive tab having a size corresponding to a size of the second further receptacle and being received therein, whereby the respective asymmetrical configurations, and the differently sized conductive tabs and differently sized first and second further receptacles ensure that, when said light emitting element is received by said holder, and said holder is received by said socket seat, and said first and second conductive tabs are received by said first and second further receptacles, said first conductive tab can only be in electrical contact with said first lead, and said second conductive tab can only be in electrical contact with said second lead.

2. The lamp assembly recited in claim 1, wherein said light emitting element comprises a light emitting dipolar substance.

3. The lamp assembly recited in claim 1, wherein the base of said light emitting element has an outer periphery with a flat surface portion, and the receptacle of said holder is partially defined by a flat surface portion that abuts against the flat surface portion of the light emitting element when the base of said light emitting element is received in the receptacle of said holder, the respective flat surface portions ensuring the base of said light emitting element is received in the receptacle of said holder in the only one position.

4. The lamp assembly recited in claim 1, wherein the outer periphery of the plug portion of said holder has a flat surface portion, and the receptacle of said socket seat is partially defined by a flat surface portion that abuts against the flat surface portion of said holder when the plug portion of said holder is received in the receptacle of said socket seat, the respective flat surface portions ensuring the plug portion of said holder is received in the receptacle of said socket seat in the only one position.

5. The lamp assembly recited in claim 1, wherein the outer periphery of the plug portion of said holder has a recessed surface portion, and the receptacle of said socket seat is partially defined by a projecting surface portion that abuts against the recessed surface portion of said holder when the plug portion of said holder is received in the receptacle of said socket seat, the recessed surface portion and the projecting surface portion ensuring the plug portion of said holder is received in the receptacle of said socket seat in the only one position.

* * * * *